US005106161A

United States Patent [19]

Meiller

[11] Patent Number: 5,106,161

[45] Date of Patent: Apr. 21, 1992

[54] CUSHION PORTION FOR A SEAT

[75] Inventor: Hermann Meiller, Amberg, Fed. Rep. of Germany

[73] Assignee: Grammer AG, Amberg, Fed. Rep. of Germany

[21] Appl. No.: 573,451

[22] Filed: Aug. 27, 1990

[30] Foreign Application Priority Data

Aug. 31, 1989 [DE] Fed. Rep. of Germany ..... 3928883

[51] Int. Cl.[5] ..... A47C 7/02; A47C 7/74

[52] U.S. Cl. ..... 297/453; 5/468

[58] Field of Search ..... 297/453, 180; 5/461, 5/468, 469

[56] References Cited

U.S. PATENT DOCUMENTS

| | | | |
|---|---|---|---|
| 2,012,042 | 8/1935 | Gerlofson et al. | 297/453 X |
| 3,137,523 | 6/1964 | Karner | 297/180 |
| 3,681,797 | 8/1972 | Messner | 297/180 X |
| 3,736,022 | 5/1973 | Radke | 297/453 |
| 4,866,800 | 9/1989 | Bedford | 5/468 |

FOREIGN PATENT DOCUMENTS

| | | | |
|---|---|---|---|
| 2837608 | 3/1980 | Fed. Rep. of Germany | 297/455 |
| 1306875 | 9/1962 | France | 297/453 |
| 2032269 | 5/1980 | United Kingdom | 5/468 |

*Primary Examiner*—Peter R. Brown

*Attorney, Agent, or Firm*—Elliot M. Olstein; Raymond J. Lillie

[57] ABSTRACT

A cushion portion for the squab or the backrest of a seat with an air-conditioning zone comprises a basic element and a cover element disposed in an opening in the basic element. A cavity provided between the basic element and the cover element is in fluid communication with the top side of the cushion portion through a plurality of spaced-apart apertures extending through the cover element in conical depressions therein. Further apertures provide a fluid communication with the cavity at the edge of the basic element or the cover element.

5 Claims, 2 Drawing Sheets

FIG.2
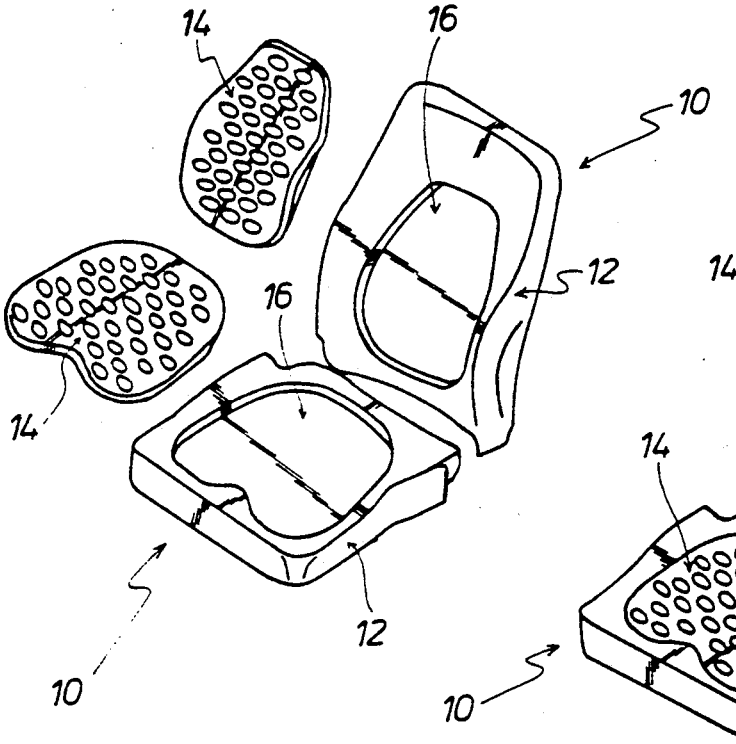
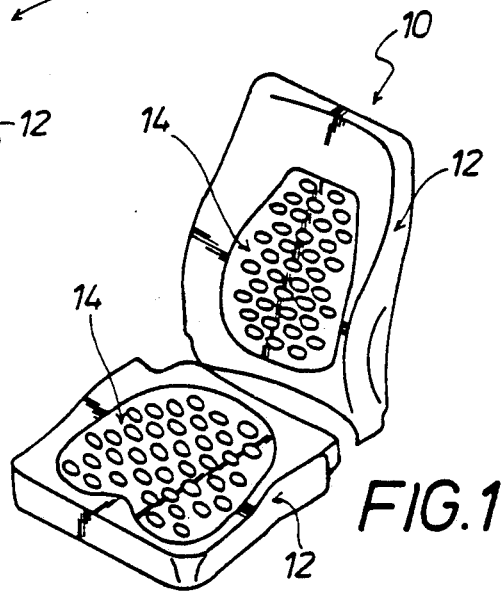
FIG.1
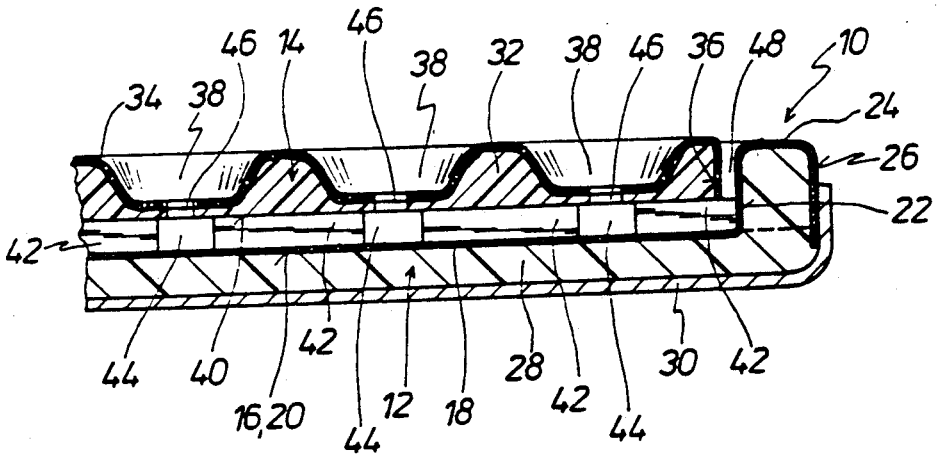
FIG.4

CUSHION PORTION FOR A SEAT

BACKGROUND OF THE INVENTION

In an effort to enhance the level of comfort for the occupant of a seat, it is possible for the seat to be designed in such a way as to provide what might be called an air-conditioning effect, insofar as the seat can provide for a flow of air through a part thereof so as to improve what might be termed the climate of the seat. That consideration may be particularly important for example in relation to a vehicle seat in which seat occupant comfort can be a matter of paramount importance. In one form of a cushion portion for a seat with an air-conditioning zone, as disclosed for example in DE 36 26 984 C1, which is particularly intended for a vehicle seat, the cushion portion has a cover comprising at least two cover portions which are connected together along common edges, with at least one cover portion which is impervious to air having a plastic foam backing thereon. To produce the cushion portion the interconnected cover portions are fitted into a mold and secured thereto by a clamping frame structure. The mold is then closed by means of a mold cover and the cover portions forming the cover for the seat portion are caused to bear snugly against the walls of the mold cavity. A reaction mixture is then introduced into the mold, the reaction mixture foaming up as the reaction takes place and filling the mold. The cushion portion can be removed from the mold after the reaction has occurred, to produce a foam filling for the cushion portion. The cushion portion and the process for producing same also involves the use of a second cover portion for the cushion portion, which is permeable to air. An insert portion is disposed on the or each permeable cover portion, and thereupon a foil which is impermeable to air is fixed to the permeable cover portion in the vicinity of the or each insert portion, and is arranged to cover the peripheral surface of the insert portion. The foil is then secured to the cover member of the mold and the mold is then closed by the cover member. After the reaction of the reaction mixture has taken place, that is to say after termination of the reaction mixture foaming process and after the cushion portion has been removed from the mold, a separate cushion portion is disposed in the space in the previously molded cushion, which is formed by the insert member. Accordingly it will be seen that that procedure involves a first molding operation to produce a first cushion portion which is of a generally frame-like configuration with a space therein, and a second operation in which a separate cushion portion is fitted thereinto. That process therefore involves a number of working steps and that has an effect on the production costs of the cushion portion. It is also necessary to provide a base element to receive the two cushion portions.

SUMMARY OF THE INVENTION

An object of the present invention is to provide a cushion portion for a seat with an air-conditioning effect, which is comparatively simple to produce while affording an excellent level of seat and air-conditioning comfort.

Another object of the invention is to provide a cushion portion for a seat which affords a satisfactory air-conditioning action while being of a simple and versatile structure and in which a part of the cushion portion which is liable to suffer from wear can be readily replaced as required.

In accordance with the principles of the present invention, these and other objects are achieved by a cushion portion for a seat with an air-conditioning zone, comprising a basic element having a top side with an opening therein, and a cover element which is of such a configuration as to be adapted in respect of shape and dimension to the opening in the basic element, to be replaceably accommodated therein. The cover element has an underside which faces into the opening in the basic element and comprises a plurality of spaced-apart projections thereon. When the cover element is fitted into the opening in the basic element, the spaced-apart projections hold the cover element at a spacing from the adjoining surface of the opening in the basic element, thereby to define a cavity therebetween. On its top side which is remote from the basic element the cover element has a plurality of spaced-apart depressions, with apertures in the depressions extending through the cover element to provide a fluid communication between the exterior of the cushion portion and the cavity defined between the basic element and the cover element. The basic element and the cover element may comprise any suitable plastic foam material.

By virtue of the provision of the cavity between the basic element and the cover element, the cavity being in fluid communication with the top side of the cushion portion and in particular the top side of the cover element thereof, by way of the plurality of spaced-apart apertures in the depressions in the cover element, a flow of air may occur between the top side of the cushion portion and the cavity therein. In that connection, a non-constant distribution of temperature over the surface of the cushion portion may provide for a certain chimney effect through the cavity in the cushion portion, the chimney effect producing a certain draw action to activate the flow of air through the air-conditioning zone of the seat. That flow of air can remove moisture from the top surface of the cushion portion, thereby substantially enhancing the 'climate' of the seat. That enhancement in the level of seat occupant comfort can thus be achieved by using relatively simple means, while also affording the advantage that the basic element and the cover element are simple to produce by molding the plastic foam material. A further advantage of the configuration according to the invention is that a worn cover element can be easily replaced by a fresh cover element, provided obviously that the basic element does not also suffer from wear such as to require replacement thereof.

It will be noted at this point that the cushion portion according to the principles of the invention may constitute the squab portion of a seat or the backrest portion of a seat or both.

The cover element can advantageously be fitted in the opening in the basic element with a slight clamping force so that the cover element is satisfactorily held in position without requiring additional fixing means. That therefore facilitates production of the cushion portion. Production is similarly facilitated by virtue of the feature that the projections for defining the cavity between the cover element and the basic element are provided on the underside of the cover element. It would also be possible for the projections to be provided on the surface of the opening in the basic element, which faces towards the cover element, the important consideration being that defined between the basic element and the cover element and between the projections is a cavity which is in fluid communication with the top surface of the cushion portion through the spaced-apart openings.

It will be appreciated that the depressions in the cover element enhance the level of seat occupant comfort by encouraging the provision of a large volume of air between the occupant of the seat and the cavity defined between the cover element and the basic element. It will be further appreciated that such depressions do not have an adverse effect upon the level of seat occupant comfort. More specifically, the air-accommodating spaces defined by the depressions can promote the removal of warm and/or moist air, which occurs if the seat is occupied over a prolonged period of time, from the region of the seat occupant, to the cavity between the basic element and the cover element and through the cavity to the exterior of the cushion portion.

In a preferred feature, the depressions are of a configuration such as to enlarge conically towards the top surface of the cover element. Such a cover element can be produced by a simple procedure and can be easily removed from a mold for producing same, while there is also the advantage that the support surface of the cushion portion can be suitably optimised in that way. The conical configuration of the depressions also ensures that the cover element enjoys satisfactory mechanical strength and stability in respect of shape.

In another preferred feature, provided at the peripheral edge of the cover element and/or the basic element are spaced-apart outlet openings which are in fluid communication with the cavity between the basic element and the cover element. Hot and/or moist air can be removed from the cavity through the outlet openings, more particularly as a result of a chimney or draw effect, as the part of the surface of the cushion portion at which the outlet openings are disposed will normally be in operation at a lower temperature than the central part of the surface of the cushion portion on which a seat occupant sits or against which a seat occupant rests the back. As the outlet openings in the cover element and/or the basic element can be produced directly during production of the corresponding element, the provision of the outlet openings does not result in an increase in the production costs of the cushion portion.

In another feature of the invention, the basic element preferably comprises a first plastic foam material and the cover element comprises a second plastic foam material which is of greater hardness than that of the basic element. That construction can provide enhanced seating comfort by virtue of the yielding nature of the basic element and the comparatively greater degree of stiffness and rigidity of the cover element carried thereon. That will contribute to reducing fatigue on the part of the occupant of the seat, even when sitting in the seat over a relatively long period of time.

In another preferred feature of the invention, the cover element may have a cover which covers it at the peripheral side edge thereof and at its top side which is remote from the basic element. The basic element may also have a cover which covers at least the opening for accommodating the cover element, the adjoining edge portion of the top surface of the basic element which extends around the opening, and the side edge extending around the basic element. A basic element and a cover element of that configuration can be produced in the form of foam-backed members comprising a foam core and a cover enclosing same.

Preferably, between the top surface of the cover element and the downwardly facing support surfaces of the projections provided on the underside thereof, which surfaces are in a common plane, the cover element is of a thickness which is at least equal to the depth of the opening in the basic element for receiving the cover element. That configuration provides that the top or support surface of the cover element is aligned with the top surface of the basic element, which extends around the opening accommodating the cover element, or projects above same by a certain small amount.

Further objects, features and advantages of the present invention will be apparent from the following description of a preferred embodiment thereof.

BRIEF DESCRIPTION OF THE DRAWING

FIG. 1 is a highly diagrammatic perspective view of a seat comprising a first cushion portion forming the seat squab and a second cushion portion forming the backrest, without however showing frame components or connecting members between the squab portion and the backrest portion, FIG. 2 is a similar view to that shown in FIG. 1, but with the cover elements removed from the basic elements in both cushion portions forming the seat, FIG. 4 is a view in section taken along line IV—IV in FIG. 3.

DESCRIPTION OF THE PREFERRED EMBODIMENT

Figure 3:
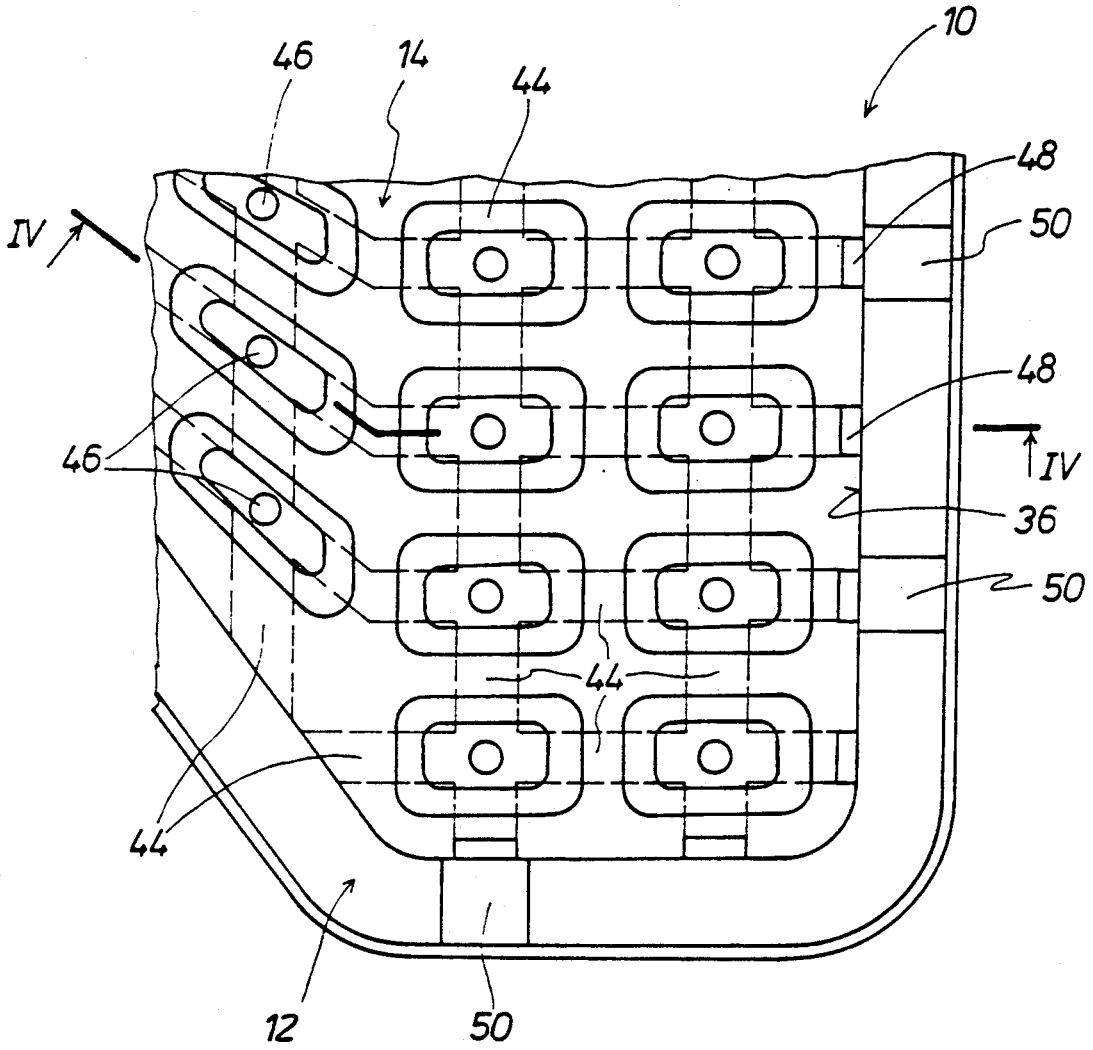
FIG. 3 is a view of part of a cushion portion, seen from above.

Referring to FIGS. 1 and 2, reference numeral 10 therein identifies a cushion portion for forming the squab of a seat such as a motor vehicle seat and also a cushion portion for forming the backrest of the seat. The or each cushion portion 10 comprises a basic element 12 and a cover element 14.

As can be clearly seen in particular from FIG. 2, the basic element 12 of the respective cushion portion 10 is provided in its top surface with an opening in the form of a recess having an at least generally flat bottom surface, as indicated at 16. The opening 16 is adapted in terms of its configuration and dimensions to the peripheral contour of the cover element 14 which is to be fitted therein. It will be noted from FIGS. 1 and 2 that the openings 16 and the cover elements 14 used in the seat squab and in the backrest portion are of respectively different configurations.

Reference will now be made to FIGS. 3 and 4 showing part of one of the cushion portions 10 illustrated in FIGS. 1 and 2, clearly showing the basic element 12 and the cover element 14. The view shown in FIG. 4 illustrates the way in which the basic element 12 has the opening or recess 16 in the top surface thereof, being adapted in respect of shape and dimensions to the shape and dimensions of the cover element 14 so that the cover element 14 can be arranged in the opening 16 in the basic element 12 in such a way as to be readily replaceable, for example in the event of wear of the cover element. The cover element 14 can also be retained in the opening 16 by virtue of a preferably slight clamping effect applied to the cover element 14 by the surfaces of the opening 16.

As shown also in FIG. 4, the basic element 12 comprises a cover 18 for covering the bottom surface 20 and the side surface 22 of the opening 16, as well as an edge portion 24 which extends around the opening 16 and which forms the upwardly facing surface of the basic element 12. The cover 18 also extends over the edge of the basic element 12 to cover the external edge surface indicated at 26 thereof. The basic element 12 also comprises a core 28 of a suitable foam plastic material and accommodated in a dish-like support member as indicated at 30.

The cover element 14 which is replaceably accommodated in the opening 16 in the basic element 12 comprises a core as indicated at 32 in FIG. 4, of a plastic foam material, the hardness thereof preferably being greater than that of the core 28 of the basic element 12. The core 32 of the cover element 14 is covered with a cover as indicated at 34 in FIG. 4, which covers over the top side or surface and the outside edge 36 of the cover element 14.

The cover element 14 is provided in its top surface with a plurality of spaced-apart depressions 38 which are of such a configuration as to enlarge conically towards the top surface of the cover element 14, which thus faces upwardly in FIG. 4, away from the bottom surface of the opening 16 in the basic element. In addition, provided on the underside 40 of the cover element 14, which is towards the bottom surface of the opening 16 in the basic element 12, is a plurality of spaced-apart projections 42 which thus hold the cover element 14 at a spacing from the bottom surface of the opening 16, to define a cavity 44 between the basic element 12 and the cover element 14, between the projections 42. The cavity 44 thus extends coherently between the basic element 12 and the cover element 14.

The cover element 14 is also provided with a plurality of spaced-apart openings 46 which are provided through the cover element 14 and more specifically through the core 32 and the cover 34 thereof, being disposed in the bottoms of the respective depressions 38. A further fluid communication between the cavity 44 and the exterior is afforded by openings as indicated at 48 in FIG. 4, which are provided at the peripheral outside edge 36 of the cover element 14. The openings 48 are also clearly visible in FIG. 3. Besides the spaced-apart openings 48 at the edge 36 of the cover element 14, vent passages or ducts 50 may also be provided on the basic element 12, as shown in FIG. 3. The vent passages 50 provide a fluid communication between the exterior and the cavity 44 defined between the basic and cover elements 12 and 14. Like the openings 48, the vent passages 50 provide outlet openings through which air can escape from the cavity 44, that air possibly carrying moisture therewith. It will be seen therefore that moisture can be removed from the top side or surface of the cushion portion 10 through the cavity 44 by a natural chimney or air-draw effect, thereby to provide what might be termed an air-conditioned cushion portion for a seat.

It will be appreciated that the above-described structure has been set forth solely by way of example and illustration of the principles of the present invention and that various modifications and alterations may be made therein without thereby departing from the spirit and scope of the invention.

What is claimed is:

1. A cushion portion for a seat with an air-conditioning effect, comprising a basic element having a top side providing an opening therein, and a cover element which has a configuration adapted in respect of shape and dimension to the opening in the basic element and which is replaceably accommodated in said opening, said cover element having an underside which faces into said opening and which comprises a plurality of spaced-apart projections thereon, thereby defining a cavity means between said cover element and the adjoining surface of the opening in the basic element and between said spaced-apart projections, and said cover element being provided on its top side which is remote from the basic element with spaced-apart depressions and apertures disposed in said depressions, and extending through said cover element to provide a fluid communication with said cavity means, and wherein each of said depressions has a conically enlarging configuration toward said top side of said cover element, and further including spaced-apart outlet openings at the peripheral edge of said cover element and spaced-apart outlet openings at the peripheral edge of said basic element, said spaced-apart outlet openings of said cover element and said basic element providing a fluid communication with said cavity means.

2. A cushion portion as set forth in claim 1 wherein said basic element comprises a first foam plastic material and said cover element comprises a second foam plastic material of greater hardness than that of the basic element.

3. A cushion portion as set forth in claim 1 wherein said cover element comprises a cover which covers the top side thereof and a peripherally extending side edge portion thereof.

4. A cushion as set forth in claim 1 wherein said basic element includes, a top edge portion adjoining said opening and extending therearound, and a peripherally extending side edge portion, and further including a cover covering at least said opening for accommodating the cover element.

5. A cushion portion as set forth in claim 1 wherein the surfaces of said projections which face towards the surface of said opening are disposed in a common plane and wherein between the top side of the cover element and said surfaces of the projections the cover element is of a thickness which is at least equal to the depth of the opening in the basic element.

* * * * *